United States Patent [19]

Cadenhead, Sr.

[11] Patent Number: 4,617,218

[45] Date of Patent: Oct. 14, 1986

[54] TIGHTLY CURLED, CUT PILE, TUFTED CARPET

[75] Inventor: Roy A. Cadenhead, Sr., Calhoun, Ga.

[73] Assignee: Modern Fibers, Inc., Calhoun, Ga.

[21] Appl. No.: 653,079

[22] Filed: Sep. 21, 1984

Related U.S. Application Data

[63] Continuation-in-part of Ser. No. 515,132, Jul. 19, 1983.

[51] Int. Cl.[4] ..... B32B 3/02

[52] U.S. Cl. ..... 428/92; 28/159; 156/61; 156/72; 156/148; 156/221; 264/230; 264/345; 273/DIG. 13; 428/17; 428/96

[58] Field of Search ..... 156/61, 148, 72, 221; 28/159; 264/230, 345; 428/17, 96, 92; 273/DIG. 13

[56] References Cited

U.S. PATENT DOCUMENTS

| | | | |
|---|---|---|---|
| 3,012,303 | 12/1961 | Whitaker et al. | 28/159 |
| 3,832,759 | 9/1974 | Eskridge et al. | 28/255 |
| 3,837,980 | 9/1974 | Nishimura et al. | 428/17 |
| 4,061,804 | 12/1977 | McCulloch | 428/17 |
| 4,265,849 | 5/1981 | Borenstein | 156/72 |

FOREIGN PATENT DOCUMENTS

| | | | |
|---|---|---|---|
| 48-15714 | 5/1973 | Japan | 28/159 |
| 1163732 | 9/1969 | United Kingdom . | |

*Primary Examiner*—John J. Gallagher

*Attorney, Agent, or Firm*—Sutherland, Asbill & Brennan

[57] ABSTRACT

A process of making a cut pile, tufted carpet that has the tightly curled appearance of Persian lamb is dislcosed. It comprises the steps of:

(a) knitting a synthetic carpet facing yarn, e.g., a continuous filament nylon, into a deknittable fabric, (b) heating the fabric to a temperature at which the curves and bends generated in the yarn by its knitted configuration are established in the yarn's memory, (c) cooling the fabric to about room temperature, (d) deknitting the cooled fabric and rewinding the unravelled yarn under enough tension to restraighten it, (e) tufting the yarn as facing yarn into a primary carpet backing material, forming a cut pile carpet, which then can be dyed, (f) coating the underside of the carpet with a heat-settable adhesive that, when cured, will help anchor the tufts of yarn in the backing material, and (g) heating the adhesive-coated carpet to a temperature at which the adhesive will set and the facing yarn will reconform to the bends and twists in its memory.

28 Claims, 6 Drawing Figures

TIGHTLY CURLED, CUT PILE, TUFTED CARPET

Figure 1:
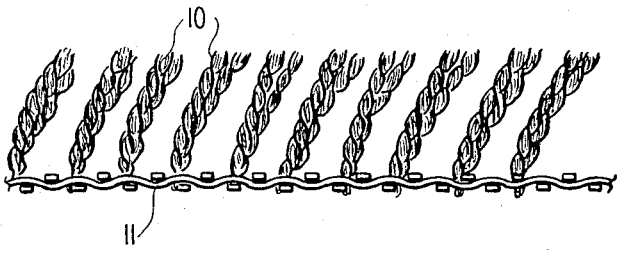

This application is a continuation-in-part of U.S. patent application Ser. No. 515,132, filed July 19, 1983.

The present invention has to do with cut pile, tufted carpets. It resides in a process for producing such carpets in a way that the pile will be tightly curled, giving it an appearance much like Persian lamb. Also, the pile is nondirectional—i.e., when looking down on the top of the carpet there is no evidence of the direction of the tufting lines.

A problem that has long troubled the carpet industry is the directionality of the pile, meaning the visibility of the tufting lines, which has been an inherent result of the tufting process. Directionality is a problem for a variety of reasons. Certain imperfections in a particular cone of facing yarn, such as incorrect dye receptivity or lack of denier continuity, will ordinarily show up as a straight line, or streak, in the pile of the dyed, finished carpet. Thus these imperfections are easily noticed, lowering the value of the carpet. Also, considerable waste is generated when piecing together a carpet having directional lines. When using the carpet in a wall-to-wall installation, for example, waste is generated because all the pieces must have their tufted lines running in the same direction, in order for the finished product to be aesthetically pleasing.

I have invented a process of making a cut pile, tufted carpet that is non-directional and, therefore, free of the drawbacks just described. My process uses carpet facing yarn made of continuous filaments or spun staple fibers of a thermoplastic, synthetic resin, and produces a carpet having the tightly curled appearance of Persian lamb. The process comprises the steps of:

(a) knitting the yarn into a deknittable fabric, (b) heating the fabric to a temperature at which the curves and bends generated in the yarn by its knitted configuration are established in the yarn's memory, (c) cooling the fabric to about room temperature, (d) deknitting the cooled fabric and rewinding the unravelled yarn under enough tension to restraighten it, (e) tufting the unravelled yarn as facing yarn into a primary carpet backing material, forming a cut pile carpet having a pile height in the range of about $\frac{3}{8}$ to $\frac{7}{8}$ inch, (f) coating the underside of the carpet with a heatsettable adhesive that, when cured, will help anchor the tufts of yarn in the backing material, and (g) heating the adhesive-coated carpet to a temperature at which the adhesive will set and the facing yarn will reconform to the bends and twists in its memory.

Steps (a) through (d) may be performed without dyeing the fabric. Steps (d) and (e) may be performed without fluffing the unravelled yarn.

I have found that by using the process just described the strands of facing yarn in the finished carpet are curved and bent in all different directions, resulting in a non-directional texture for the carpet and giving it the tightly curled appearance of Persian lamb. Piecing the carpet is thereby facilitated. Also, streaking is not nearly so much a problem with the carpets of this invention as with the directional carpets of the prior art. Each row of tufts in my carpet tends to blend with the adjacent rows, eliminating streak definition and making most yarn discolorations and denier imperfections far less noticeable, if they can be seen at all.

This last mentioned property also makes it easier to blend different shades of yarn in a carpet made by the present process. Thus, for instance, two or three different dye receptive levels of a greige yarn can be creeled A-B or A-B-C on a tufting machine. Then, when the carpet is dyed, the shade of the color will vary from row to row. Because each row blends in with the adjacent rows, however, the different shades will appear as intermingled dots, rather than as rows or stripes. In this manner a tweed-like blending of different shades of face yarn can be achieved at less expense than by use of the prior art method of twisting together two or three different dye receptive levels of greige yarn.

Still another advantage of carpet produced by the method of the present invention is that it will not "track", meaning the pile will not show where someone has walked over the carpet. This is a significant advantage over conventional cut pile carpets, which readily show footprints.

So far as I am aware, no cut pile synthetic carpet made by prior art methods has had the tightly curled appearance mine has. In U.S. Pat. No. 3,012,303 (Whitaker et al.) a process is described for making multi-colored nylon carpet, which also involves knitting and deknitting the face yarn prior to tufting. In that process, however, the knitted fabric is dyed in localized areas and the unravelled yarn is mechanically fluffed to increase its diameter. The resultant yarn is so opened up, that when it is used to make cut pile carpet the yarn ends lose their definition and become highly splayed, producing an unformed, wooly look, rather than the appearance of tight curls with good tip definition, which my carpet has. For a time this patented process was used commercially to make carpet having uncut pile loops, but, so far as I am aware, it has never been used commercially to make cut pile carpet.

The present invention is useful primarily with carpet facing yarn made of polyester, polypropylene, or polyamide (nylon) continuous filaments or spun staple fibers. Such yarns are, of course, well known. Suitable resins include, for example, polyethylene terephthalate, nylon 6, nylon 11, nylon 66, nylon 610, and nylon 611. Blended yarns, such as nylon with polyester, can be used as well.

Preferably the continuous filaments or staple fibers will be crimped, for example, to the extent of about 10 to 20 crimps per inch. Crimping is a process well known in the art. It gives the individual filaments or fibers a saw-toothed appearance. Crimping makes for a bulkier, less slippery yarn—one that more closely approaches the look and characteristics of yarns spun from natural fibers, such as wool. Usually crimping is performed by running continuous filament tow between the intermeshing gears of a mechanical crimper, or by passing it through a stuffer box or past a pulsating air jet. The crimp is preferably made latent by stretching the yarn, prior to subjecting it to the first step in my process, that of knitting.

The filaments or staple fibers of which the yarn is formed preferably will have a filament denier of about 6 to 25. The yarn should have a total denier of about 600 to 9000, preferably about 900 to 9000. Each ply of the yarn is preferably twisted, e.g., about 3 to $5\frac{1}{2}$ turns per inch. One to three plies is preferred. The plies in multiply yarn should also be twisted around one another about 3 to $5\frac{1}{2}$ turns per inch. The use of two ply, continuous filament yarn is preferred.

The yarn can either be colored or greige. Usually it will be greige, however, and the carpet will be dyed after it leaves the tufting machine.

The knitting of the yarn can be performed using any deknittable stitch. Examples of such are the flat jersey stitch, the purl stitch, and the loopstitch. Knitting stitches are definable in part by the distance between the needles (gauge) and the length of the stitch (depth). For purposes of the present invention it is preferred to use a gauge in the range of about ¼ inch to ¾ inch and a depth in the range of about ¼ inch to ½ inch. The heavier the yarn denier, the longer the gauge and depth. The yarn can be knitted into a tubular fabric or a flat fabric.

After the yarn is knitted into fabric, the fabric is heat treated to establish a permanent memory of the bends and curves of the knit stitch configuration. The temperature of the heat treatment needs to be high enough to fix the bends and curves in the yarn's memory, but not so high as to soften or melt the yarn. (Most thermoplastic fibers used in carpet facing yarns today have melting points of 300° F. or above.) While the preferred memory-instilling temperature will vary with the chemical composition of the yarn filaments or fibers, usually it will be preferred to heat the yarn to a highest temperature in the range of about 230° to 290° F. The preferred range for polyester is about 230° to 260° F. For nylon it is about 230 to 290° F. For polypropylene it is about 230° to 280° F.

The present process works best if the knitted fabric is heated uniformly, meaning that the heat penetrates the tightest regions of the stitches, as well as the surface filaments or fibers. I have found that that can be accomplished quite well by using a particular heating procedure: first subjecting the fabric to a partial vacuum, and then repeatedly subjecting the fabric to pressurized steam, followed by releasing the steam pressure and allowing the fabric temperature to drop about 20 to 50, or even up to 65, degrees (F.). Preferably the fabric will be subjected to at least three such steam injections, with the first injection being the mildest, i.e., establishing a lower treatment chamber temperature and for a shorter duration than the subsequent injections. This procedure (vacuum followed by three or more steam surges, separated by pressure releases) may best be carried out in a conventional yarn processing autoclave. Preferably the initial evacuation will be to a vacuum of about 23 to 26 inches of mercury. It is also preferred to pull a vacuum on the autoclave after the final steam injection, so as to partially dry the fabric before it is deknitted. And usually it will be preferred to subject the fabric to yet another drying step before deknitting it. Relatively mild drying conditions are preferred—for example a temperature in the range of about 210° to 250° F.

After the heat treatment, and after any drying step that might follow, the fabric is cooled to at or near room temperature and deknitted, for example on a winder. As the yarn unravels from the fabric, it is rewound under enough tension to straighten it. The higher the denier of the yarn, the more tension that will be required.

The deknited, restraightened yarn is tufted into primary carpet backing material in the conventional manner for making cut pile carpet, for example using a Wilton cut pile loom or a conventional tufting machine. The present process is most effective if the height of the pile is at least about ½ inch and if the face density of the carpet is at least about 10, most preferably at least about 36, ounces per square yard.

The present process does not depend upon the use of any special carpet backing materials. Thus, for example, the primary backing material may be woven or non-woven and may be formed of jute or of various synthetic fibers, such as polyester, polyacrylonitrile, polypropylene, or nylon. Other suitable materials are 5 to 10 ounce, resin-coated, non-woven fabric formed of acrylic staple fibers that are needle punched into a nylon scrim; ⅛ inch thick polyurethane foam sheet, cast over a woven nylon scrim (e.g., Chemback brand tufting medium from Chemstrand Company); 10 ounce woven acrylic fabric; and non-woven fabric prepared from polyethylene terephthalate staple fibers.

When I refer herein to a heat-settable adhesive being applied to the underside of the primary carpet backing material, I mean any of the heat-curable liquids or pastes that are normally used to anchor the tufts or facing yarn into the primary backing material. Included are liquid cements, such as latex adhesives, that are used to glue a secondary carpet backing to the primary backing; rubber solutions that are sometimes used without a secondary backing to provide what are referred to as marine backings; flexible resinous coating compositions, such as non-foaming polyurethane coating compositions, that are used without a secondary backing to provide extremely durable carpets; and foam compositions that are cast and cured directly on the underside of the primary backing to provide a resilient backing and underpad, all in one. The present process may be used in making all of these types of carpet.

Examples of suitable liquid cements that can be used to glue a secondary carpet backing to the primary backing material are latexes of natural rubber, styrene-butadiene rubber (SBR), nitryl-butadiene rubber (NBR), and ethylene-vinyl acetate copolymers. As with the primary backing, the choice of the secondary backing material is not believed to be critical to the invention either. Woven and non-woven fabrics can be used, and pre-cast sheet foam material can be used as well. Examples of suitable secondary backing materials include woven jute; non-woven rayon-polyolefin scrims; foamed, closed cell polyvinyl chloride (PVC) or polyethylene pads; and woven polypropylene fabrics. The use of a secondary backing generally gives the carpet greater dimensional stability and better wearing properties. Also, the bounce properties of the carpet can be easily controlled or adjusted by selection and use of a particular secondary backing material.

The gluing of the secondary backing to the primary backing can be done in a latex oven. The temperature used will depend upon the particular cement that is chosen; usually, however, it will be in the range of about 245° to 280° F. (referring to the face temperature, i.e., the temperature of the surface of the pile).

Application of the liquid cement to the underside of the primary backing need not always be for the purpose of gluing a secondary backing to the carpet. If desired, the cement can be heat-set, or cured, without being covered, and the carpet then can be used without further treatment, or a final covering can be applied in a separate operation. In making foam-backed carpets, for example, a latex adhesive can be applied to the underside of the primary backing material and cured, and then the foam can be cast over it in a separate operation.

Marine backings are non-foamed rubber coatings, usually so thin that the texture of the underside of the primary backing material can be seen through the marine backing. Carpets with marine backings are often used on boats (whence comes the name) and in low budget applications. To create a marine backing, the carpet is normally turned face down and a rubber solution is painted on the underside of the primary backing material; then the carpet is heated in a finishing oven, for example to a face temperature in the range of about 210° to 240° F. The weight of a marine backing is usually about 12 to 18 ounces per square yard of carpet.

Non-foaming resinous coating compositions are used most often on the underside of carpets intended to be subjected to exceptionally hard wear. Most often polyurethane resins are used for this purpose. Such undercoatings provide an extremely tough and durable carpet. Using a special machine, the resinous composition is normally coated onto the underside of the primary backing material, while the carpet lies face down, at a weight of about 10 to 60 ounces per square yard (cured weight). The coating can be cured in a modified finishing oven, for example at a face temperature in the range of about 230° to 275° F.

Heat-settable foam compositions that can be cast on the back of carpets are likewise well known in the art. They include, for example, polyvinyl chloride plastisols and polyurethane foams. The foaming may be accomplished physically or chemically, the foams may be open-celled or closed-celled. Application rates usually will be in the range of about 18 to 36 ounces per square yard (cured weight). The foam can be cast and cured on the underside of the carpet in a foam machine. Face temperatures most often will reach a high in the range of about 240° to 275° F. during curing.

Depending, then, on the particular type and composition of the adhesive used, the heating of the adhesive-coated carpet in the process of the present invention will reach a maximum temperature usually in the range of about 210° to 275° F. As already indicated, this heating step serves a dual purpose. It sets the adhesive, while at the same time causing the individual fibers in the facing yarn to bend, twist, and curl in all different directions, in an effort to resume their former configurations in the knitted fabric. In that manner total non-directionality can be achieved.

When greige yarn is used in the process and the carpet is dyed before the adhesive is applied to its underside, some of the yarn's curly appearance can be developed in the dyeing operation. If dyeing is conducted at elevated temperatures, as it usually is, that will cause the face yarn to begin to bend, twist and curl in all different directions. The higher the temperature, the more the curls will be developed. The dyeing usually will be done in boiling water and it will require the subsequent adhesive-setting temperatures to fully develop the curliness of the yarn.

For illustration purposes, the following procedure describes what I presently contemplate to be one of the best embodiments of practicing my invention to make a luxury carpet for indoor use, using a carpet facing yarn made of continuous filament nylon:

An undyed, 2-ply nylon carpet yarn is selected for use as the face yarn. The yarn is made from continuous filament nylon 66 (DuPont, regular dye) that has about 10 to 20 crimps per inch. At this point, however, the crimp is substantially latent, due to the straightening tension exerted on the filaments during the yarn twisting process. The filament is 18 denier. Each ply has 5 turns per inch and a denier of 1850. The two plies are twisted together to the extent of 5 turns per inch as well, and the total yarn denier is 3700.

The yarn is knitted into tubing on a circular knitter having a 12 inch diameter head and 90 needles. A flat jersey stitch is used. The knitter is set at a gauge of 0.4 inch and at a depth of about ½ inch. This results in a fabric having about 3 stitches per inch, measured in its relaxed condition.

The knitted tubing is placed into open mesh bags, at a rate of 30 pounds of tubing per bag. Eight (8) of the bags are placed in a Challenger-Cook steam tumbler and are tumbled in live steam for 10 minutes. The tumbler's thermostat is set at 190° F., which is reached about 2 minutes into the cycle. This steam tumbling causes the yarn filaments to manifest most of their latent crimp, giving the yarn its maximum bulk.

The bags of knitted tubing are next put into the two baskets (8 bags per basket) of a Turbo FS-1200 autoclave. There, the tubing is subjected to the following stepwise treatment:

(1) Pull 26 inches (Hg) vacuum and hold for 1½ minutes.

(2) Inject steam to a temperature of 230° F. and hold there for 3 minutes.

(3) Exhaust steam, allowing the temperature to drop to about 215° F.

(4) Reinject steam to 280° F. and hold there for 5 minutues.

(5) Exhaust steam, allowing the temperature to again drop to about 215° F.

(6) Reinject steam to 280° F. and hold there for 5 minutes.

(7) Exhaust steam, allowing the temperature to again drop to about 215° F.

(8) Reinject steam to 280° F. and hold there for 5 minutes.

(9) Pull 26 inches vacuum and hold for 3 minutes.

The bags of partially damp tubing then are dried in a steam-heated Challenger-Cook dryer, set at 250° F. The tubing is tumbled in the dryer for 6 minutes.

The dried tubing is then deknitted by winding the yarn onto 7 pound cones. A tension of about 100 grams is placed on the yarn by use of a brake, in order to restraighten it. This also serves to resubdue some of the crimp in the yarn's filaments. The yarn is now ready for tufting, and the cones are removed to the tufting creel.

Figure 4:
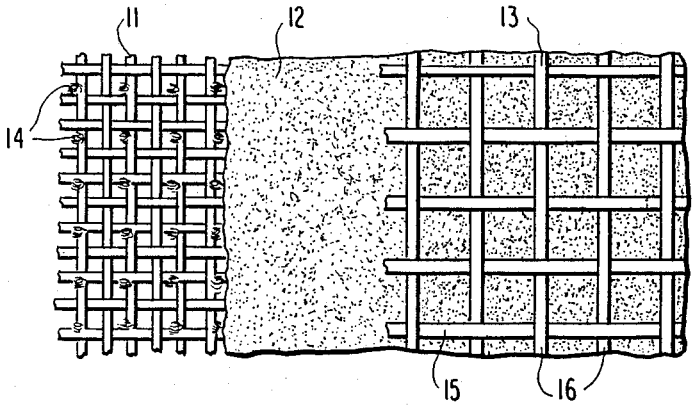
Figure 5:
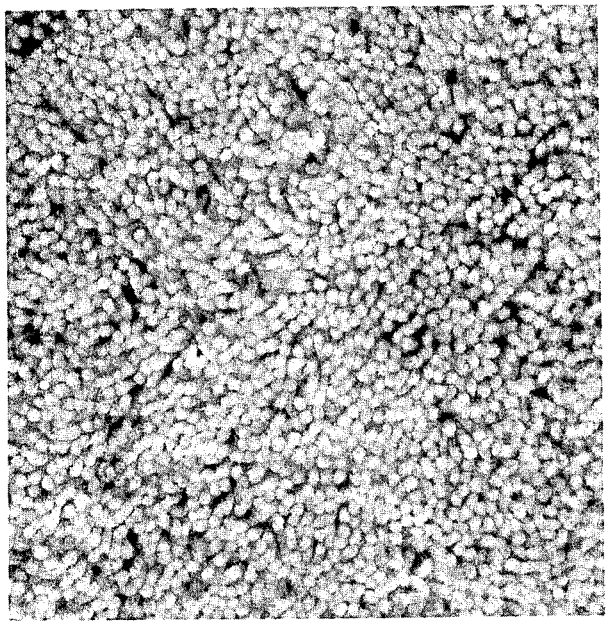

Using a conventional, 3/16 inch gauge, cut pile tufting machine, the deknitted yarn is tufted onto a primary backing made of woven polypropylene. The pile height for the fabric is ⅞ inch, and the face weight is 55 ounces per square yard. FIGS. 1 and 5 of the drawings accompanying this specification illustrate the product at this stage of the process. FIG. 1 is a sketch in a larger-than-actual size scale of a side view of the carpet. The proportions in FIG. 1 have been distorted somewhat for purposes of clarity. FIG. 5 is a photograph of what the carpet at this stage typically looks like from a top view. It happens not to be a photograph of the precise carpet described in this example, but it looks the same. Note from FIG. 1 how all of the tufts (10) of the facing yarn lean to the right, giving the pile a directional appearance. The only support for tufts (10) at this stage in the manufacturing process is the primary backing material (11). As shown in FIG. 4 of the drawings, primary backing (11) is made of polypropylene ribbon woven in a basket-weave pattern.

The greige, unfinished carpet of FIGS. 1 and 5 is transported from the tufting machine to a Beck Dyer, in which the carpet is batch dyed with a regular dye (neither a deep dye nor a cationic dye) in batches of 600 to 900 linear feet. During the dyeing operation the bath temperature rises from that of tap water to boiling. The dyed, unfinished carpet is rinsed with tap water, removed from the Beck, and placed in a gas-fired, circulating air dryer. The drying chamber is maintained at about 280° F., and the carpet is kept there until dry.

Figure 2:
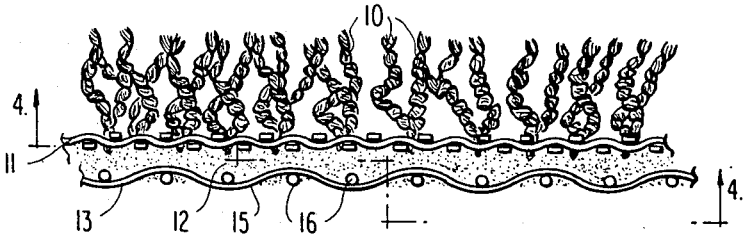
Figure 3:
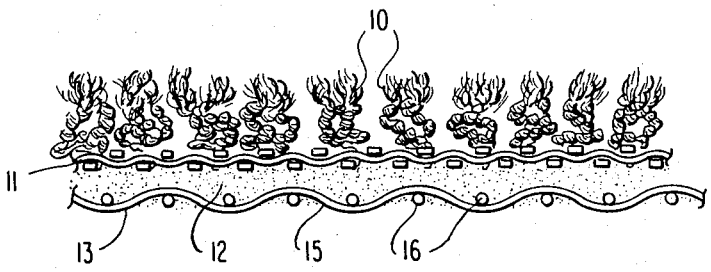

The dyed, unfinished carpet is taken from the dryer and fed into a latex oven for lamination to a secondary backing. A latex adhesive is applied to the underside of the unfinished carpet at an application rate of 28 ounces per square yard, and the coated carpet is immediately laid on top of a secondary carpet backing, resulting in the laminated structure shown in FIG. 2 of the accompanying drawings. Referring to those drawings, the latex is shown as (12) and the secondary backing as (13). As depicted in FIGS. 2, 3 and 4, the secondary backing (13) is a basket weave fabric composed of jute in both the warp direction (15) and the filling direction (16). As seen in FIG. 2, much of the yarn's curliness is developed at this stage of the process, due to the heat of the dyeing operation. FIG. 4 is a bottom sectional view of the carpet, taken along the line 4—4 in FIG. 2. From left to right, FIG. 4 shows bottom views of the primary backing (11) (in which the bases (14) of the yarn tufts (10) are visible), the latex adhesive (12), and the secondary backing (13).

Figure 6:
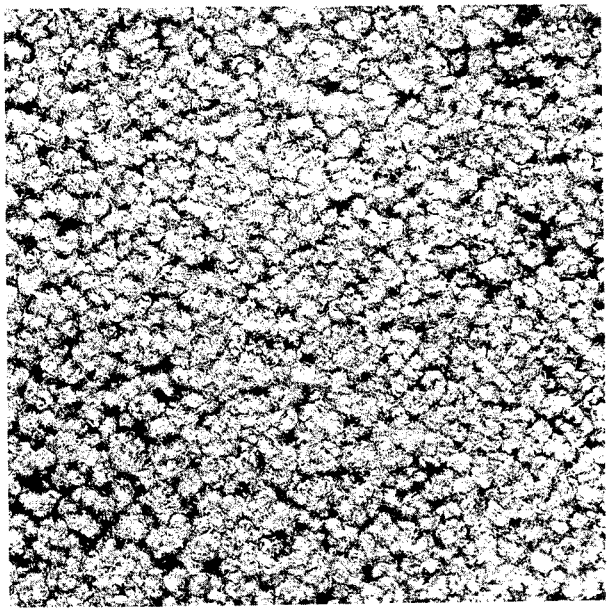

As the final step in the process, the laminated structure shown in FIGS. 2 and 4 is heated in the latex oven to a face temperature of about 245° F. The heating causes the latex adhesive to set, or cure, and also causes the strands of the facing yarn to finish reconforming to the bends, curves, and turns in their memory. The resulting product is shown in FIGS. 3 and 6 of the accompanying drawings. FIG. 3 is a sketched side view. FIG. 6 is a photographed top view. As illustrated in FIG. 3, the individual tufts of facing yarn (10) are now so bent and twisted that the carpet no longer reveals tufting lines and is totally non-directional. The face yarn has excellent tip definition, however, and, as shown in FIG. 6, the dyed carpet has the tightly curled appearance of Persian lamb.

I claim:

1. A process of making a non-directional, cut pile, tufted carpet having the tightly curled appearance of Persian lamb, comprising the steps of (a) knitting a carpet facing yarn composed of continuous filaments or spun staple fibers of thermoplastic, synthetic resin into a deknittable fabric, said yarn having a denier of about 600 to 9,000, using knitting needles that are set a fixed distance apart, in the range of about $\frac{1}{4}$ inch to $\frac{3}{4}$ inch, (b) heating the fabric to a temperature at which the curves and bends generated in the yarn by its knitted configuration are established in the yarn's memory, (c) cooling the fabric to about room temperature, (d) deknitting the cooled fabric and rewinding the unravelled yarn under enough tension to restraighten it, this step and said steps (a) through (c) being performed without dyeing the fabric, (e) tufting the unravelled yarn as facing yarn into a primary carpet backing material, forming a cut pile carpet having a pile height greater than the between-needles distance used in step (a) above, and pile height being in the range of about $\frac{3}{8}$ to $\frac{7}{8}$ inch, this step and said step (d) being performed without fluffing the unravelled yarn, (f) coating the underside of the carpet with a heat-settable adhesive that, when cured, will help anchor the tufts of yarn in the backing material, and (g) heating the adhesive-coated carpet to a temperature at which the adhesive will set and the facing yarn will reconform to the bends and twists in its memory, thereby producing a finished carpet having the tightly curled appearance of Persian lamb.

2. The process of claim 1 wherein the resin is nylon, polyester, or polypropylene.

3. The process of claim 1 wherein the yarn is composed of 1 to 3 plies of continuous filament nylon, polyester, or polypropylene.

4. The process of claim 3 wherein each yarn ply has a twist of about 3 to $5\frac{1}{2}$ turns per inch.

5. The process of claim 4 wherein the yarn is composed of 2 plies that are twisted together to the extent of about 3 to $5\frac{1}{2}$ turns per inch.

6. The process of claim 5 wherein the yarn fiber is greige, continuous filament nylon that has been crimped so that it has about 10 to 20 crimps per inch, and the cut pile carpet from step (e) is dyed before being subjected to the coating operation of step (f).

7. The process of claim 6 wherein the adhesive is a latex adhesive.

8. The process of claim 1 wherein, in step (a), the knitting is performed at a depth in the range of about $\frac{1}{4}$ inch to about $\frac{1}{2}$ inch.

9. The process of claim 7 wherein, in step (a), the knitting is performed at a depth in the range of about $\frac{1}{4}$ inch to about $\frac{1}{2}$ inch.

10. The process of claim 1 wherein the resin is nylon, polyester, or polypropylene, and, in step (b), the highest temperature to which the fabric is heated is in the range of about 230° to 290° F. for nylon, about 230° to 260° F. for polyester, and about 230° to 280° F. for polypropylene.

11. The process of claim 9 wherein, in step (b), the highest temperature to which the fabric is heated is in the range of about 230° to 290° F.

12. The process of claim 1 wherein the yarn fiber is continuous filament nylon, polyester, or polypropylene; the yarn has 1 to 3 plies; and in step (g) the adhesive-coated carpet is heated to a face temperature in the range of about 245° to 280° F.

13. The process of claim 11 wherein in step (g) the adhesive-coated carpet is heated to a face temperature in the range of about 245° to 280° F.

14. The process of claim 12 wherein, in step (e), the tufting is done to obtain a face density of at least about 10 ounces per square yard.

15. The process of claim 13 wherein, in step (e), the tufting is done to obtain a face density of at least about 36 ounces per square yard.

16. The process of claim 10 wherein, in step (b), the fabric is heated by a procedure involving first subjecting the fabric to a partial vacuum, then repeatedly subjecting the fabric to pressurized steam, followed by releasing the steam pressure and allowing the temperature of the fabric to drop about 20 to 65 degrees (F.).

17. The process of claim 15 wherein, in step (b), the fabric is heated by a procedure involving first subjecting the fabric to a partial vacuum, then repeatedly subjecting the fabric to pressurized steam, followed by releasing the steam pressure and allowing the temperature of the fabric to drop about 20 to 50 degrees (F.).

18. The process of claim 1 wherein, in step (g), the carpet is heated while laminating it to a secondary backing material.

19. The process of claim 15 wherein, in step (g), the carpet is heated while laminating it to a secondary backing material.

20. The process of claim 17 wherein, in step (g), the carpet is heated while laminating it to a secondary backing material.

21. A carpet produced by the process of claim 1.

22. A carpet produced by the process of claim 4.

23. A carpet produced by the process of claim 6.

24. A carpet produced by the process of claim 14.

25. A carpet produced by the process of claim 18.

26. A carpet produced by the process of claim 19.

27. A carpet produced by the process of claim 20.

28. The carpet of claim 27 wherein the primary carpet backing material is made of woven polypropylene and the secondary backing is made of woven jute.

* * * * *